United States Patent [19]

Spindler

[11] 4,068,984

[45] Jan. 17, 1978

[54] MULTI-STAGE SCREW-COMPRESSOR WITH DIFFERENT TOOTH PROFILES

[75] Inventor: Walter G. Spindler, Munich, Germany

[73] Assignee: H & H Licensing Corporation, Miami, Fla.

[21] Appl. No.: 529,115

[22] Filed: Dec. 3, 1974

[51] Int. Cl.[2] ..... F01C 1/16; F01C 11/00; F04C 17/12; F04C 23/00

[52] U.S. Cl. ..... 418/9; 418/199; 418/200; 418/201

[58] Field of Search ..... 418/9, 10, 197, 199–203

[56] References Cited

U.S. PATENT DOCUMENTS

| | | | |
|---|---|---|---|
| 2,975,963 | 3/1961 | Nilsson | 418/9 |
| 3,209,990 | 10/1965 | Akerman | 418/9 |
| 3,265,292 | 8/1966 | Schibbye | 418/9 |
| 3,279,682 | 10/1966 | Vagenius | 418/9 |
| 3,622,256 | 11/1971 | Borisoglebsky et al. | 418/201 |
| 3,910,731 | 10/1975 | Persson et al. | 418/9 |

*Primary Examiner*—John J. Vrablik

*Attorney, Agent, or Firm*—Stevens, Davis, Miller & Mosher

[57] ABSTRACT

A screw compressor has at least two pairs of compressor rotors arranged in series, the outside diameter of the rotors of the two pairs being substantially the same, and the ratio of the outside diameter to the diameter at the base of the rotor teeth or vanes of the second pair being such that the capacity of the rotors corresponds to the intake volume of fluid to be compressed flowing from the first to the second pair of rotors.

7 Claims, 5 Drawing Figures

MULTI-STAGE SCREW-COMPRESSOR WITH DIFFERENT TOOTH PROFILES

The invention relates to a screw compressor system for compressing gaseous media, preferably such compressors having a small suction intake volume, provided with rotors inside a housing.

In many instances screw or propeller compressors are preferred when compressing gaseous media. Air also comes under the term of gaseous medium. The screw compressors are fairly economical and reliable. As regards their operation, the gaseous medium to be compressed is sucked through a suction line to the operational chamber of the compressor. If the medium to be compressed is air, the air ordinarily will be sucked in from the surrounding atmosphere, a suction filter being provided in the suction line. The sucked in gaseous medium is compressed in known manner in the operational chamber of the screw compressor by being forced through two intermeshing screw threads belonging to two rotors mounted in the compressor housing from the suction side to the pressure side of the compressor, the volume of the compression passages containing the gas or air gradually decreasing. The gaseous medium, when compressed to its final pressure, will then be expelled through a high-pressure exhaust line from the operational chamber of the screw compressor to the location of use or to the suction pipe of a subsequent screw compressor stage.

Helical screw compressors of the type contemplated by the invention are disclosed, for example, in U.S. Pat. Nos. 3,311,291 and 3,692,441. Such screw compressors have a housing which fits closely about intermeshing male or driving rotor and female driven rotor. An air intake port is provided in the housing at one end of the screws and a discharge port for compressed air or the like at the other end of the housing. The screws are provided with helical grooves which are of decreasing volume in order that gas passing through the housing is compressed. The clearance between the addendum of the rotor teeth and the housing is held to a minimum.

The known screw compressors for economical reasons are so designed that for a given rotor diameter, there will be maximum filling of the individual grooves between the screw threads. This means that the teeth or screw thread of one rotor penetrates the groove of the other rotor as much as possible, i.e., that the cross-section of the teeth is as large as feasible, to a point that the rotor retains just enough sufficient stability for reliable compressor operation.

When the volume of the intake port is small, the design of known screw compressors is essentially the same as for larger intake ports, though the outside diameter of the rotor will be selected appropriately smaller. However, in order to avoid excessive back flow losses, a given tangential speed must be maintained which may not drop below 10 to 45 m/sec. for oil-injection screw compressors and even 50 to 75 m/sec, for dry operation compressors so a rotor rpm high enough to correspond to this minimum tangential speed must be selected. But high rotor rpms entail various drawbacks, above all, high compressor noise. Besides, a minimum suction intake volume of about 10 to 13 $m^3$/min. must be maintained in conventional screw compressors, because the play between the rotors and the housing may not fall below a given minimum value if jamming of the rotors is to be avoided. It follows that, when one drops below a given rotor size, the play or clearance between the rotor and housing and hence, the back flow losses are too large with respect to the gas moved forwardly and, in the extreme case, no gas will issue from the pressure side of the compressor.

The problems listed above, and mainly when compressing small suction intake volumes while being required to minimize back flow losses as well as noise generation, will occur especially when a first compressor stage is followed by several other stages in a series thereof. Generally a compressor system comprises two compression stages or, in other words, two sets of intermeshing rotors disposed in tandem. As a rule, the rotor diameters of the second stage in such known two-stage screw compressor systems will be about half the size of the rotor diameters of the first stage. Correspondingly, the rotor rpm in the second stage generally will be about 1.5 to 2 times the rotor rpm of the first stage. It will be easily recognized therefore that these differing suction intake volumes in the two stages, which are accounted for in the design of the system, will be especially disadvantageous in view of high compressor noise in the second stage, there being also further drawbacks due to high rpms in this latter stage, its rotor bearings and its drive. A very appreciable problem furthermore is caused by the design described in detail above which reduces the output of these known screw compressors.

The present invention is directed to the provision of a simple and effective screw compressor system for compressing gaseous media, preferably for small suction intake volumes, provided with rotors located inside a housing, which is free from the drawbacks found in known screw compressor systems.

This problem is solved by the invention in that the outside diameter of the rotors (i.e., the diameter to the peripheral edges of the teeth) is large with respect to the volume of the suction intake and in that the ratio of the said outside diameter to the diameter of the dedendum of the teeth (i.e., the diameter to the bases of the grooves between the teeth) is small enough to provide a magnitude of the front cross-section which will correspond to the suction intake volume. Advantageously, the contour of the teeth of the rotors is of such design and dimensions that the ratio of the tooth width at its smallest point to the width of the groove between the teeth at its widest point of the female rotor will be large, for instance, it will be at least 0.5 to 1.5, preferably about 1. Besides, as regards the present invention, the outside diameters of the male and female rotors and also the diameters of the dedendum parts of the two rotors of a screw compressor will correspond to one another at least approximately.

The invention is based on the insight that the ratio of the outside to dedendum diameters of the meshing rotors of a known screw compressor is selected to provide for maximum filling of the grooves of the thread and minimum rotor diameters. Indeed, the ratio of the two diameters in known rotors is kept as large as possible. It is easy to see that, in a certain sense, there will also be a positive effect, i.e., in direction of the size of the screw compressor. On the other hand, as regards the known screw compressors, because of the deep rotor penetration of the grooves, especially of the female rotor, the contours of the teeth may be small and therefore there will be correspondingly short paths for the leakage of gas between the individual screw thread grooves both at the rotor periphery and at the pressure-side of the rotor with attending markedly high back-flow losses.

The invention deviates from the known ratios for the two diameters, whereby essential advantages described in greater detail below are obtained with respect to design and operation in the screw compressor systems of the invention. Because in a screw compressor of the invention smaller suction intake volumes are accounted for not merely be reducing the rotor diameters but rather while keeping a rotor diameter as large as possible by setting a reduced outside dedendum diameter ratio in the sense of adapting the front cross-section of the individual screw thread grooves to the particular suction intake volume, the screw compressor system of the invention allows compressing gaseous media even in the presence of the smallest intake volumes while eliminating to the highest degree any back-flow losses. The compressor also runs quietly. It will be easily seen that, because of the shorter rotor penetration of the grooves by the teeth, and on account of the relatively large tooth width, and hence, because of the longer path resulting therefrom for the leakage flow between the individual screw thread grooves, both at the rotor periphery and through the grooves, there will only be small back-flow losses. The greater quietness of operation is obtained because the rotors can be operated at low rpm. The tangential speed is sufficiently high even with small rotors because of the large outer diameter of the rotors. It will be easily understood that lower rotor rpms are further advantageous because of lower construction costs for the compressor, fewer problems with bearing lubrication and the systems. Also, less shut down time for repairs can be expected. The invention therefore provides, especially where the smallest outputs are involved, for achieving the highest gas compressions at lower cost with reduced lubrication by oil injection. Lastly, the screw compressor of the invention, because of its ruggedness as compared to the known types, is especially resistant to problems which occur in operation such as rotor sagging, compressor vibrations and the like.

The advantages of the invention will be especially evident when using a screw compressor system with two or more compression stages or rotor pairs. Where, according to the invention, the rotors of the two compression stages are substantially of the same outside diameter but the ratio of the outside or addendum diameter to the dedendum diameter of the rotors in the second stage is smaller than that of the first stage so as to correspond to the ratio of the suction intake volume of the two stages. As regards such a screw compressor system, there will be especially an improvement in the conditions in the second compression stage with respect to the known two-stage compressor systems, and this to a marked degree.

It is further of especial advantage to drive the rotors of the various compressor stages at the same rpm.

This allows an advantageous design of the invention, whereby the rotors of the repeating compression stages of a compressor are provided with drive shafts mounted in parallel, the shafts being driven via a spur gear by means of drive gears of equal sizes and associated with the individual compression stages. In another embodiment, which is equally advantageous, the rotors of all of the compression stages are provided with one common drive shaft.

The invention is explained in further detail below by means of embodiments shown in diagrammatic form in the drawing.

Figure 1:
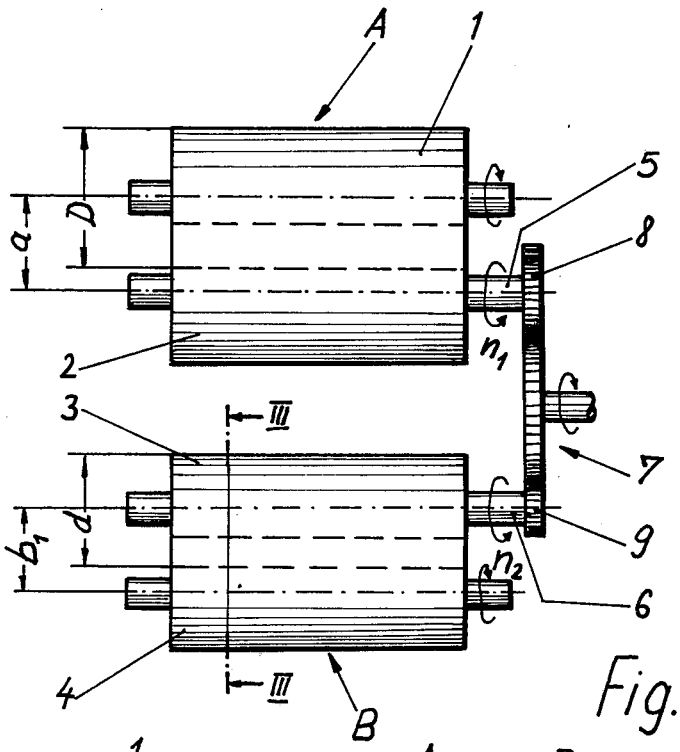
Fig. 1 Prior Art
FIG. 1 is a plan view of a known, two-stage screw-compressor system.
Figure 2:
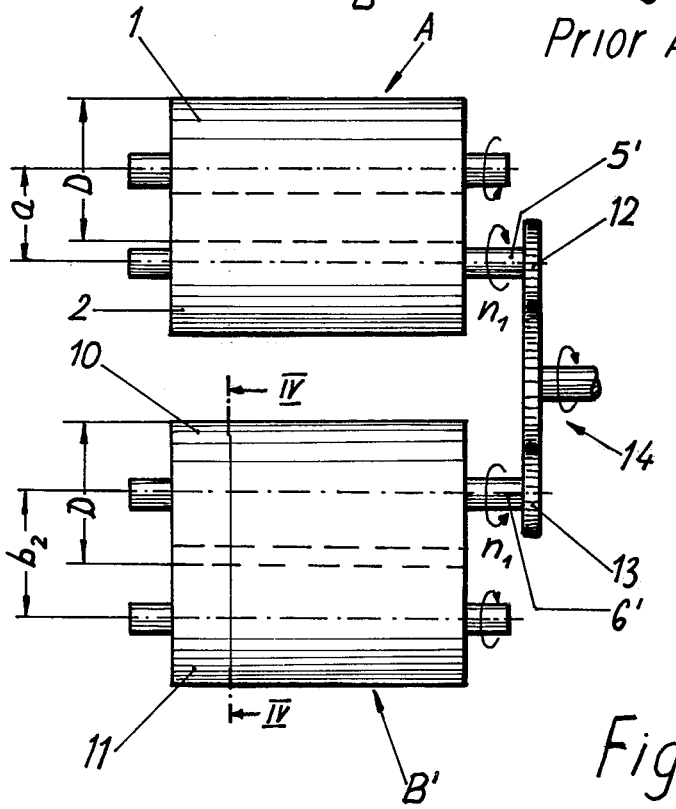
FIG. 2 is a plan view of a two-stage compressor system per the invention.

FIGS. 1 and 2 illustrate one screw compressor system of the prior art and one of the invention, each having two screw compression stages. The rotors having meshing teeth or vanes are mounted in conventional manner in a compression housing as illustrated in the patents identified hereinbefore. The gas to be compressed is forced in each compression stage through the operational chamber and is compressed in the same manner as in the prior art devices as described above. The gas issuing from the pressure-side of the first compression stage or pair of meshing rotors is directed to the low-pressure side of the second compression stage or pair of rotors for the purpose of further compression. This also applies to the embodiment of FIG. 5.

The known screw compressor system shown in FIG. 1 is provided with a first compression stage A and a second one, B. The first stage has two meshing rotors 1,2 of the same outside diameter D. The rotational axes of rotors 1 and 2 are spaced apart.

The second stage B of the known screw compressor system has two meshing rotors 3,4 of the same outside diameter $d$ which, corresponding to the reduced suction intake rate of the second compression stage B, is less than the outside diameter D of rotors 1,2 of the first stage A. The ratio of the outside diameter $d$ (FIG. 3) to the diameter $e$ of the dedendum of the teeth, FIG. 3, of rotors 1,2 and 3,4 is fairly large, and will differ in the two stages A and B depending on the differing suction intake volumes. Therefore, the rotational axes of rotors 3 and 4 of the second compression stage B will be a distance $b_1$ apart, which is less than the distances between the axes, $a$, in the first compression stage A.

Both compression stages A and B have drive shafts 5 and 6 for the male rotors which are mounted parallel to each other and which are driven by a spur gear unit. The particular drive gears 8 and 9 on drive shafts 5 and 6 differ in size so that the drive rpm $n_2$ of the second compression stage B is greater than the drive rpm $n_1$ of the first compression stage A. This characteristic of the known screw compressor system results from the fact that the rotor diameter $d$ is smaller in the second compression stage B than rotor diameter D in the first compression stage A, and furthermore, from the requirement of a given minimum tangential speed also for the second compression stage B in order to maintain the back-flow losses within acceptable limits.

The screw compression system of the invention shown in FIG. 2 has a first compression stage A and a second compression stage B'. In order to provide pictorial comparison of the second compression stage B' especially designed in conformity with the invention with the corresponding second compression stage B of the known screw compression system (FIG. 1), the first stage A of the screw compression system of the invention corresponds precisely to the first compression stage A of the known screw compressor system shown in FIG. 1 as regards dimensions and drive rpm $n_1$. It is further assumed that the compression problem, i.e., the kind and nature of the gas to be compressed, the supply flow and the predetermined intermediate and final pressures will be the same for both the known and the inventive screw compressor facilities.

The second compression stage B' especially designed in conformity with the invention as shown in FIG. 2 has two meshing rotors of equal size, 10 and 11. Despite the lesser gas intake volume of the second compression stage B' with respect to the first compression stage, the outside diameter D of rotors 10 and 11 is relatively large in accordance with the invention and advantageously corresponds to the rotor diameters D of the first compression stage A. In accordance with the invention, the ratio of outside diameter D to dedendum diameter E (FIG. 4) of rotors 10,11 is relatively small. Therefore the spacing $b_2$ between the rotational axes of rotors 10 and 11 is enlarged with respect to a minimum value (for instance, $b_1$ in FIG. 1) in such manner that a front cross-section of the individual screw thread grooves which correspond to the suction intake volume in the second compression stage B' is obtained.

These relationships are described in further detail with reference to the cross-sectional drawings of FIGS. 3 and 4. Suffice it to say at present that keeping as large as possible a rotor diameter D in the second compression stage B' as well permits a sufficiently large tangential speed in order to limit back-flow losses in accordance with the invention, without requiring an increase in the drive rpm in the second stage. In particular, if the rotor diameter D, as in the embodiment shown, of the second compression stage B' corresponds to that of the first stage A, then drive gears 12 and 13 of spur gear 14 of the screw compression system of the invention may be of the same size. This means that the drive rpm $n_1$ may advantageously be the same in both compression stages A and B' of the screw compression system of the invention. Hence, the advantages discussed above are obtained with respect to the much higher rpm $n_2$ in the second compression stage B of the known screw compressor system (FIG. 1), above all, also a reduction of noise in the said stage B'. Lastly, the ratio of top diameter D to bottom diameter E (FIG. 4) of rotors 1,2 and 10,11 in the two stages A and B', respectively, will so differ that the spacing $b_2$ in the second compression stage B' will also be larger than the axis spacing $a$ in the first compression stage A and corresponding to the reduced suction intake volume of B'.

Figure 3:
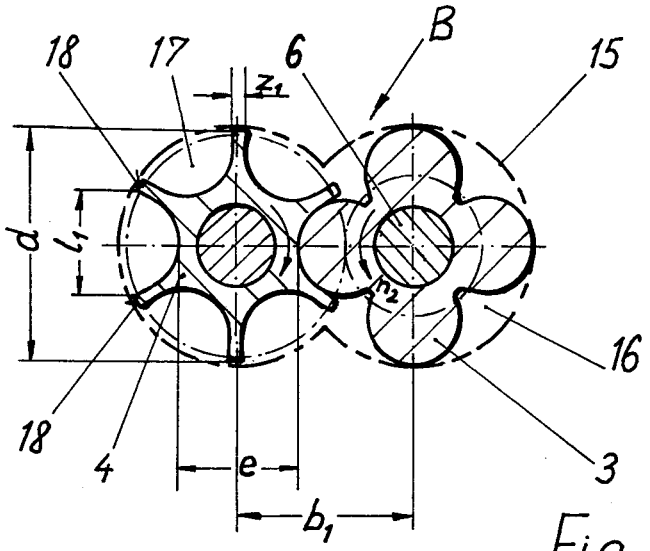
Fig. 3 Prior Art
FIG. 3 is a cross-sectional view taken along the line III—III of the second compression stage of the known compressor system of FIG. 1.
Figure 4:
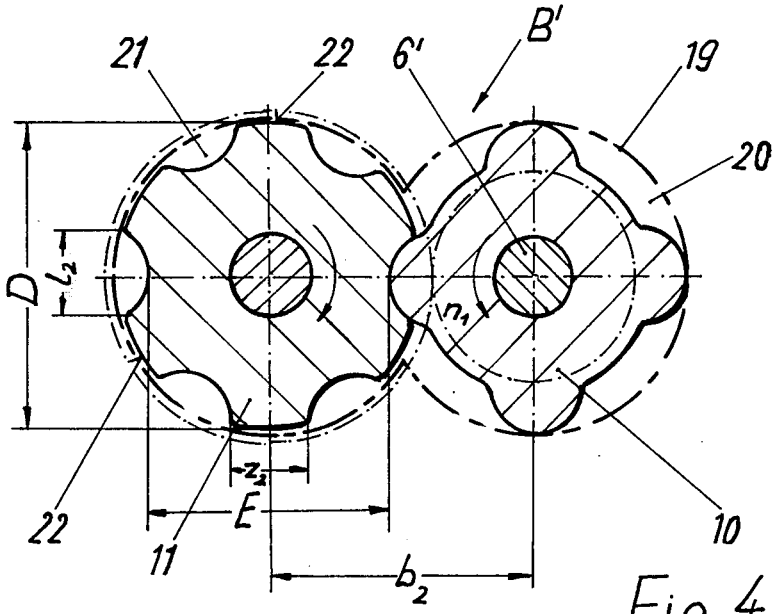
FIG. 4 is a cross-sectional view taken along the line IV—IV of the second compression stage of the screw compressor system of the invention illustrated in FIG. 2.

A comparison is made in FIGS. 3 and 4 between the cross-sections of the second compression stages B and B' of the known and inventive screw compressor systems. FIG. 3 shows the rotors 3 and 4 of the known screw compressor in a housing 15 indicated by a broken line. Rotor diameter $d$ is relatively small and the drive rpm $n_2$ of rotors 3 and 4 is correspondingly large. As may be seen, the ratio of outside diameter $d$ to dedendum diameter $e$ is relatively large, so that a maximum penetration of the two rotors 3 and 4 is obtained. The rotational axes of rotors 3 and 4 therefore are apart by a rather small distance $b_1$. This determines the depth of the grooves 16 and 17. Furthermore, the pronounced penetration of the teeth of rotors 3 and 4 requires that the tooth width $z_1$ of female rotor 4 and hence, the sealing edges 18 passing along compressor housing 15, be narrow.

As shown by FIG. 4, rotors 10 and 11 of the screw compressor of the invention are located in a compressor housing 19 indicated by a broken line. In accordance with the invention, the ratio of the outside diameter (corresponding to the rotor outer diameter D) to the diameter E of rotors 10 and 11 is small. Hence, the rotor diameter D of the screw compressor of the invention is appreciably larger than rotor diameter $d$ of the known screw compressor (FIG. 3), so that the compressor of the invention may be driven at a correspondingly low rpm $n_1$. Even though the rotor diameter D is fairly large, one obtains a cross-section corresponding to the intake suction rate for the individual screw thread grooves 20 and 21. In particular, the cross-sectional area of the screw-thread gaps 20 and 21 between teeth of the screw compressor of the invention corresponds essentially to the cross-sectional area of the screw thread grooves 16 and 17 of the known screw compressor shown in FIG. 3. This is so because the axis spacing $b_1$ in the known screw compressor (FIG. 3) is enlarged. FIG. 4 further shows that, because of the enlarged axis spacing $b_2$ in the screw compressor of the invention, the shallower penetration of rotors 10 and 11 permits the tooth width $z_2$, especially as regards the female rotor 11 and hence the sealing edges 22 of this rotor, which pass along compressor housing 19, to be appreciably larger than is the case for the known screw compressor. Therefore, in spite of the larger rotor diameter, there will be a marked reduction of back-flow losses in the screw compressor of the invention, both at the rotor periphery and along the rotor. Obviously, there will be optimization of this advantage on account of the tooth contour of male rotor 10 which is so designed to provide long sealing edges at the rotor periphery. This fact may not be seen because of graphical limitations in the drawing.

Figure 5:
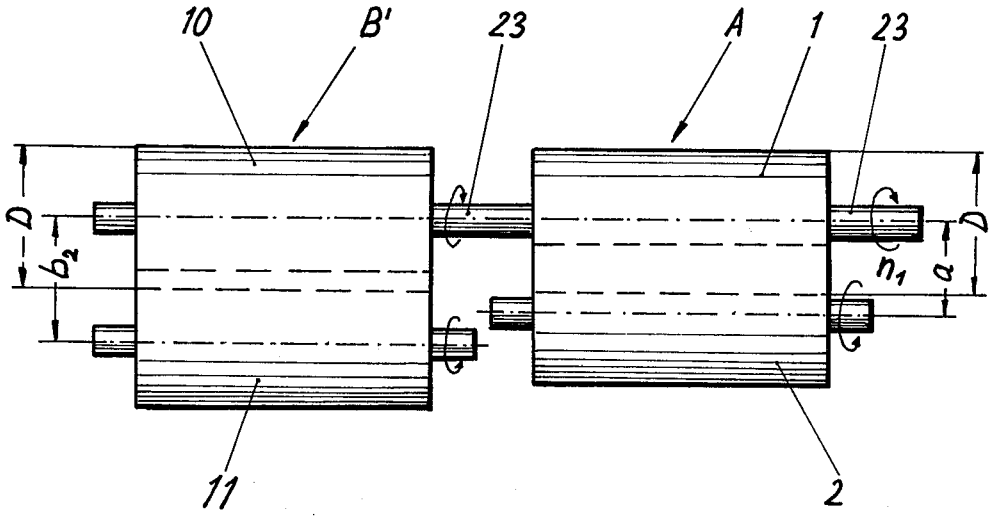
FIG. 5 is a plan view of a second embodiment of a two-stage screw compressor system of the invention.

FIG. 5 shows an embodiment of the invention which is a variation with respect to that shown in FIG. 2. This embodiment also has a first compression stage A and a second one, B', which corresponds to those of the system of FIG. 2. FIG. 2 should be consulted for details. The essential difference of this latter embodiment with respect to that of FIG. 2 is in the two compression stages being provided with a common drive shaft 23, or at least an aligned one. This feature allows a saving in torque transmission equipment, for instance, gearing, when driving the screw compressor system, and further advantages. Above all, one is enabled to select the rotor diameter D, and correspondingly the drive rpm $n_1$ of the first compression stage A and of the second one, B', may be selected to be equal.

Fundamentally, it must be noted that the description of the invention in relation to a multi-stage screw-compressor system, especially one of two stages, is merely illustrative in nature and presented merely for better understanding of the present invention, without thereby intending to restrict the scope thereof. The advantages of the invention also are fundamentally active in single-stage screw compressors, and to a particular degree, as already mentioned, when small suction intake volumes are involved, which could not be compressed at all by means of the known screw compressors because of their fundamental design.

I claim:

1. A screw compressor system for compressing gaseous media adapted to compress small suction intake volumes of media and provided with a series of pairs of meshing rotors comprising two compression stages characterized in that the rotors of each series have an outside diameter which is large with respect to the suction intake volume of gas, one of said rotors of each series being a male rotor having teeth disposed in grooves of a female rotor, the axes of rotation of the second pair of rotors being spaced farther apart from each other than the axes of rotation of the first pair of rotors, and the ratio of the diameter of the rotors at the peripheral edge of the rotor teeth to the diameter of the rotor at the base of the teeth for the pairs of rotors being so related to provide grooves which compensate for the difference in volume between the intake of fluid to the first pair and the intake to the succeeding pair of rotors and wherein the rotors of the two compressor stages have essentially the same outside diameter, the ratio of the outside diameter to the dedendum diameter of the rotors in the second stage is smaller than the ratio of the outside diameter to the dedendum diameter of the rotors in the first stage and characterized in that the tooth contours of the rotors in the second stage are so designed that the ratio of tooth width of the female rotor at its narrowest point to the tooth groove width at its widest point is at least 1.0.

2. The screw compression system of claim 1 wherein the male rotors of all of the stages are driven at the same rpm.

3. The screw compressor system of claim 1 wherein the rotors of the various compression stages are provided with drive shafts which are mounted parallel to one another and which are driven by a spur gearing by means of equally-sized drive gears associated with the individual compression stages.

4. The screw compressor system as defined by claim 1 wherein the rotors of all the compression stages are provided with a common drive.

5. A screw type fluid compressor having a series comprising two pairs of rotors disposed in a housing and comprising helical threads with grooves of decreasing volume from intake to output ends of the rotors, one of said rotors being a driving male rotor having teeth disposed in grooves of a female rotor, means for flow of fluid from the first pair of rotors to the second pair of the series, the outside diameter of the rotors of the two pairs being substantially equal to each other, the axes of rotation of the second pair of rotors being spaced farther apart from each other than the axes of rotation of the first pair of rotors, the ratio of outside diameter to the diameter of the rotors at the base of the teeth of the second pair being smaller than that of the rotors of the first pair to provide grooves which compensate for the difference in volume between the intake of fluid to the first pair and the intake to the succeeding pair of rotors, and means for driving the male rotors of the two pairs at the same speed and characterized in that the tooth contours of the rotors in the second stage are so designed that the ratio of tooth width of the female rotor at its narrowest point to the tooth groove width at its widest point is at least 1.0.

6. The screw compressor of claim 5 wherein the teeth of the threads of the male rotor in the second pair substantially fill the grooves in the female rotor.

7. The screw compressor of claim 6 wherein the teeth of the said male rotor are semi-elliptical in cross-section.

* * * * *